United States Patent [19]

Kemp

[11] Patent Number: 4,704,828

[45] Date of Patent: Nov. 10, 1987

[54] SNAP TOGETHER WINDOW WELL

[76] Inventor: Melvin T. Kemp, 1661 N. Sweetwater La., Farmington, Utah 84025

[21] Appl. No.: 872,229

[22] Filed: Aug. 11, 1986

[51] Int. Cl.[4] ..... E04F 17/06; E06B 5/02

[52] U.S. Cl. ..... 52/107; 52/195; 52/529; 285/424; 403/345

[58] Field of Search ..... 52/107, 195, 522, 529; 403/345, 105; 285/424, 921

[56] References Cited

U.S. PATENT DOCUMENTS

| | | | |
|---|---|---|---|
| 1,791,255 | 2/1931 | Wagner | 285/424 X |
| 2,209,420 | 7/1940 | Rutten et al. | 52/195 X |
| 2,308,131 | 1/1943 | Wellnitz | 52/107 |
| 3,004,634 | 10/1961 | Evans et al. | 52/107 |

FOREIGN PATENT DOCUMENTS

| | | | |
|---|---|---|---|
| 219822 | 2/1962 | Austria | 52/107 |
| 522270 | 3/1956 | Canada | 52/107 |
| 2630554 | 1/1977 | Fed. Rep. of Germany | 285/424 |
| 2920361 | 11/1980 | Fed. Rep. of Germany | 52/107 |
| 561831 | 5/1975 | Switzerland | 52/107 |

*Primary Examiner*—Alfred C. Perham

*Attorney, Agent, or Firm*—Thorpe, North & Western

[57] ABSTRACT

A window well structure comprising at least two superposed u-shaped sections made of sheet metal. Engagement means are provided on adjacent edges of the superposed sections which securely interengage each other to unite the adjacent, superposed, u-shaped sections as a unitary, self supporting, integral structure.

5 Claims, 2 Drawing Figures

SNAP TOGETHER WINDOW WELL

BACKGROUND OF THE INVENTION

1. Field

This invention relates to window wells which are positioned around windows which are partly or wholly below grade. More particularly, the invention pertains to such window wells which are made of sheet metal.

2. State of the Art

It is conventional to place a window well around a below grade window, such as a window in the basement wall of a building. Such windows are generally near the upper side of the basement wall but either partly or wholly below grade. In either situation, it is customary to place a window well around the window to protect the window from backfill and other damage. Such window wells have commonly been made from poured concrete, brick or block masonry, and preformed, galvanized metal units.

The concrete and masonry wells are formed by excavating the earth to the desired depth adjacent to the window opening and then pouring a concrete well or forming a masonry well around the window opening. In U.S. Pat. No. 2,308,131, a window well is disclosed which comprises a plurality of precast concrete members which are then disposed vertically in superposed order.

Because of decreased costs and ease of construction, preformed window well units made of galvanized sheet metal have generally replaced poured concrete and masonry window wells. The sheet metal wells have a broad U-shaped horizontal cross section, and the sheet metal is generally provided with horizontal corrugations to provide stability and strength. The sheet metal wells were formed to fit a particular opening dimension, and thus large inventories of the wells were required to cover the various sizes of openings used in the construction industry.

3. Objectives

It is a principal objective of the present invention to provide novel, sheet metal well units which are made in a uniform height and in standard widths, with the units of any standard width being capable of being locked together one on top of another of the same width to form wells having various heights. The inventory necessary to cover the various sizes of openings can accordingly be greatly reduced. A number of units in each standard width can be used to quickly form wells of any height which is a multiple of the uniform height dimension of the individual units. Thus, insread of maintaining a large, bulky inventory comprising several wells, each well of different height and width used in the construction industry, the supplier need only stock a limited number of well units of the present invention corresponding to standard widths of wells used in the industry. From such a limited inventory, wells can be made of numerous different heights.

BRIEF DESCRIPTION OF THE INVENTION

In accordance with the present invention, an improved window well construction is provided in which the window well is formed from novel units or sections of corrugated sheet meral of a broad u-shaped cross section in which the corrugations extend horizontally and circumferentially around the units. The units are formed of various widths to accomodate the numerous widths of window openings used in the construction industry. The units of each width are made to have either a uniform height or a limited number of different heights, and interlocking means are provided whereby the units of each width can be interlocked together in stacked relationship one on top of another to form wells having various heights.

The interlocking means preferably comprises snap together engagement means provided on both the upper and lower edges of each of the separate units. In particular, one of the upper or lower edges of each separate unit is provided with a male engagement and the other edge is provided with a female engagement which is adapted to receive the male engagement of a mutually respective unit in interlocking engagement.

Additional objects and features of the present invention will become apparent from the following detailed description, taken together with the accompanying drawings.

THE DRAWINGS

A preferred embodiment of the present invention representing the best mode presently contemplated of carrying out the invention is illustrated in the accompanying drawings, in which:

FIG. 1 is a pictorial of a window well structure in accordance with this invention showing three units invention connected together in vertically stacked positions and with a fourth unit exploded upwardly from the three connected units; and FIG. 2 shows a partial cut away pictorial view of the attachment of one unit of the invention to another.

DETAILED DESCRIPTION OF THE ILLUSTRATED EMBODIMENT

Figure 1:
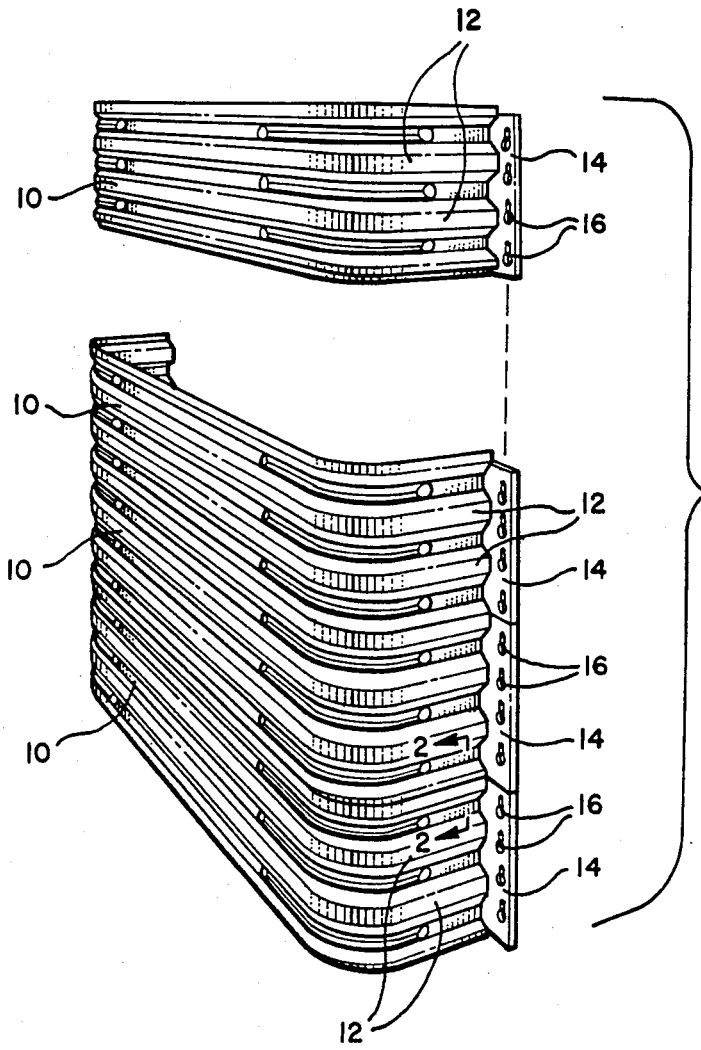

A preferred emobidment of the window well structure in accordance with the present invention is shown in the drawings. Referring now to FIG. 1 of the drawings, the well structure comprises separate sections or units 10 which can be assembed in stacked relationship one on top of another to form the desired height of the window well. Each of the sections or units 10 is formed from sheet metal to have a broad u-shaped horizontal cross section. The sections or units 10 are formed having various widths or longitudinal dimensions such that the units 10 can span the various widths of window openings used in the construction industry. The units 10 of each width are made in limited number of heights. It is feasible to form the units 10 of one uniform height, such as one foot. However, for more utility, the units 10 can be formed in two heights, such as one-half foot and one foot.

By forming the separate units 10 of various widths but only one or two heights, the inventory necessary for forming various sized window wells can be greatly reduced. Several units 10 of each width is all that a supplier need maintain in inventory to supply finished well structures for the numerous heights of window openings used in the construction industry. As shown in FIG. 1 for example, if each of the units 10 have a uniform height of one foot, then the four units can be attached together to form a window well having an overall height of four feet. By maintaining a limited number of units 10 in stock for each of the various widths used in the industry, the supplier can supply a well of various heights on the spot. Heretofore, the supplier would be required to maintian a separate window well structure for each height of openings used in the industry.

The separate units 10 are preferably formed from corrugated sheet metal with the corrugations 12 running horizontally around the u-shaped unit 10. The longitudinal ends of each unit 10 are advantageously provided with flanges 14 having a plurality of openings 16 spaced along the flanges 14. The flanges 14 are adapted to fit flatwise against the casement of the window opening or the building wall of the below grade wall (not shown in the drawings). The openings 16 can be used to accept nails or screws to attach the flanges 14 securely to the casement of the window opening or the building wall.

Figure 2:
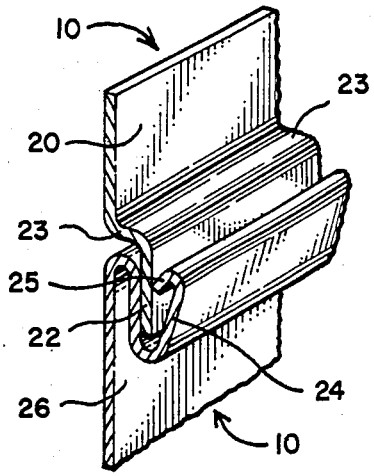

For purposes of quickly connecting the units 10 together in stacked relationship to form an integral well structure comprising the separate units 10, the upper and lower edges of each separate unit 10 are provided with engagement and connection means by which the units 10 can quickly be snapped together to form a unitary, integral well structure of the desired height. As shown in FIG. 2, one edge of each section 10 is provided with a male type engagement which can be received within a female type engagement formed along the other side of a mutually respective unit 10. As illustrated, the male type engagement 22 is formed in the bottom edge 20 of the unit 10, and the female type engagement 24 is formed in the upper edge 26 of the unit 10. This could be reversed, of course, with the female engagement being formed in the bottom edge and the male engagement formed on the upper edge. The important criteria is that each unit 10 have a male type engagement along one of its upper or lower edges and a female type engagement along the other edge opposite the male type engagement.

The male and female engagements are preferably formed along the entire length of the upper and lower sides, respectively, of each unit 10. The male type engagement 22 advantagously comprises a straight elongate section along the edge of the unit 10. To provide additional strength, an offset 23 can be formed in the sheet metal. The female type engagement preferably comprises a doubly bent back section along the edge of the unit 10. The doubly bent back section forms an open u-shaped channel into which the male type engagement can be received as shown in FIG. 2. A sharply bent lip 25 is preferably formed along the free edge of the doubly bent back section. The lip 25 is adapted to engage the side of the male type engagement 22 to tightly hold the male type engagement 22 within the female type engagement 24. As mentioned previously, the offset 23 adjacent to the male type engagement 22 provides additional strength to the edge 20 of the unit. In addition, the offset 23, as shown in FIG. 2, aligns with the outer bent back portion of the female type engagement 24 so that the exterior edges 20 and 26 of the engaged, adjacent units 10 of the window well form a smooth aligned juncture.

It is to be understood that the present disclosure, including the detailed description of the preferred embodiment, is made by way of example and that various other embodiments are possible without departing from the subject matter coming with the scope of the following claims, which subject matter is regarded as the invention.

I claim:

1. A window well structure which is to be disposed below the adjoining soil grade adjacent to a window opening in a building wall, said window well structure comprising at least two superposed u-shaped sections made of sheet metal; and engagement means on adjacent edges of said superposed, u-shaped sections which securely interengage each other to unite the adjacent, superposed, u-shaped sections as a unitary, self supporting, integral well structure, said engagement means on the adjacent edges of said superposed, u-shaped sections comprising male and female type engagement members which are formed integrally with and extend substantially along the entire length of the respective edges of said u-shaped sections, with said male type engagement members comprising flat, ribbon-like, elongate sections formed along the mutually respective entire lengths of respective one edges of said u-shaped sections, and with said female type engagement members comprising bent back sections formed along the mutually respective entire lengths of respective other edges of said u-shaped sections such that the respective bent back sections form open u-shaped channels, and further with said female type engagement members in addition comprising sharply bent lips formed along the mutually respective free edges of the bent back sections so that said lips extend downwardly and inwardly into the respective u-shaped channels, whereby interengagement between adjacent u-shaped sections is achieved by said male type engagement members being received within said female type engagement members of adjacent u-shaped members, such that said lips on said female engagement members make firm, interlocking, gripping engagement with said male type engagement members along the entire length of said male type engagement members.

2. A window well structure in accordance with claim 1 wherein means are further provided at the opposite side edges of the structure formed by the plurality of superposed, u-shaped sections for attaching the structure to a window frame or building wall.

3. A window well structure in accordance with claim 2, wherein said means at the opposite side edges of said structure for attaching said structure to a window frame or building wall comprise upright flanges which fit flatwise against the window frame or building wall.

4. A window well structure in accordance with claim 3, wherein a plurality of openings are spaced along said flanges to be used with nails or screws in attaching said structure to the window frame or building wall.

5. Individual sections which when superposed and attached to each other at adjacent junctures form a unitary, integral, self-supporting window well structure which is to be disposed below the adjoining soil grade adjacent to a window opening in a building wall, said individual sections each comprising an elongate section of sheet metal which has an upper edge, a lower edge, and two opposite side edges, with said section of sheet metal being formed so that the upper and lower edges and any cross section through said section in a plane parallel to the upper and lower edges have a broad u-shape;

a male engagement means formed along the entire length of one edge of the upper or lower edges of said section, said male engagement means comprising a flat, ribbon-like, elongate portion formed along the mutually respective entire length of the respective one edge of said section;

a female engagement means formed along the entire length of the other edge of the upper and lower edges of said section, said female type engagement means comprising a bent back portion of the other edge formed along the entire length of the other edge, wherein the bent back portion forms an open u-shaped channel, and further with said female type engagement means in addition comprising a sharply bent lip formed along the otherwise free edge of the bent back portion, so that said lip extends downwardly and inwardly into the u-shaped channel;

whereby when two of said sections are superposed in stacked relationship, the male engagement means of one section engages the female engagement means of the second section to unite the two adjacent sections into a unitary, self-supporting, integral structure, with engagement of the male engagement means within an adjacent female engagement means being accomplished such that said lip on said female engagement means makes firm, interlocking, gripping engagement with said male type engagement means along the entire length of said male type engagement means.

* * * * *